US005879054A

United States Patent [19]

Cao

[11] Patent Number: 5,879,054

[45] Date of Patent: Mar. 9, 1999

[54] ARMREST DEVICE

[76] Inventor: Zi-Wen Cao, 58, Ma Yuan West St., Taichung, Taiwan

[21] Appl. No.: 122,369

[22] Filed: Feb. 27, 1998

[51] Int. Cl.[6] ..... A47C 7/54

[52] U.S. Cl. ..... 297/411.36; 297/353; 248/297.31

[58] Field of Search ..... 297/411.36, 353; 403/105, 107, 108; 248/297.31

[56] References Cited

U.S. PATENT DOCUMENTS

| | | | |
|---|---|---|---|
| 4,639,039 | 1/1987 | Donovan | 297/353 |
| 5,588,766 | 12/1996 | Lai | 403/105 |
| 5,649,741 | 7/1997 | Beggs | 297/411.36 |
| 5,735,577 | 4/1998 | Lin | 297/411.36 |
| 5,765,920 | 6/1998 | Lai | 248/297.31 |

*Primary Examiner*—Peter M. Cuomo
*Assistant Examiner*—Anthony D. Barfield

[57] ABSTRACT

An armrest device has a main body, a cover plate, and an armrest support plate. The main body has a first chamber, a second chamber, a middle post, a groove, a first seat, and a second seat. The armrest support plate has a corrugated slot and a plurality of recess apertures.

A hook device has a shaft rod, a notch, and a through aperture. A coiled spring is inserted in the groove and the notch. An elastic plate covers the first chamber and the second chamber. A guide plate is disposed on the elastic plate. A press plate is disposed on the second seat. A press panel is disposed on the first seat. The armrest support plate is confined between the press plate and the press panel.

3 Claims, 4 Drawing Sheets

ARMREST DEVICE

BACKGROUND OF THE INVENTION

The present invention relates to an armrest device. More particularly, the present invention relates to an armrest device for a chair or for a sofa.

A conventional chair has a fixed armrest which cannot be adjusted. Since the height of the users vary from one person to another person, the user may want to adjust the height of the chair in order to fit the height of the user. However, the conventional armrest does not have any adjustment function.

SUMMARY OF THE INVENTION

An object of the present invention is to provide an armrest device which can be adjusted easily.

Accordingly, an armrest device comprises a main body, a cover plate covering the main body, and an armrest support plate inserted through a spacing defined between the main body and the cover plate. The main body has a first chamber, a second chamber, a middle post, a groove communicating with the first chamber, a first seat, and a second seat. The armrest support plate has a corrugated slot, and a plurality of recess apertures. The corrugated slot has a linear portion and a plurality of enlarged portions. A hook device has a shaft rod, a notch, and a through aperture receiving the middle post. A coiled spring has an upper end inserted in the groove and a lower end inserted in the notch. An elastic plate covers the first chamber and the second chamber. The elastic plate has an oblong hole. A guide plate is disposed on the elastic plate. The guide plate has a through hole, two protruded edges, and two protrusions. The shaft rod is inserted through the oblong hole, the through hole, and the corrugated slot. Each of the protrusions is inserted in one of the recess apertures. A press plate is disposed on the second seat. A press panel is disposed on the first seat. The armrest support plate is confined between the press plate and the press panel.

DETAILED DESCRIPTION OF THE INVENTION

Figure 1:
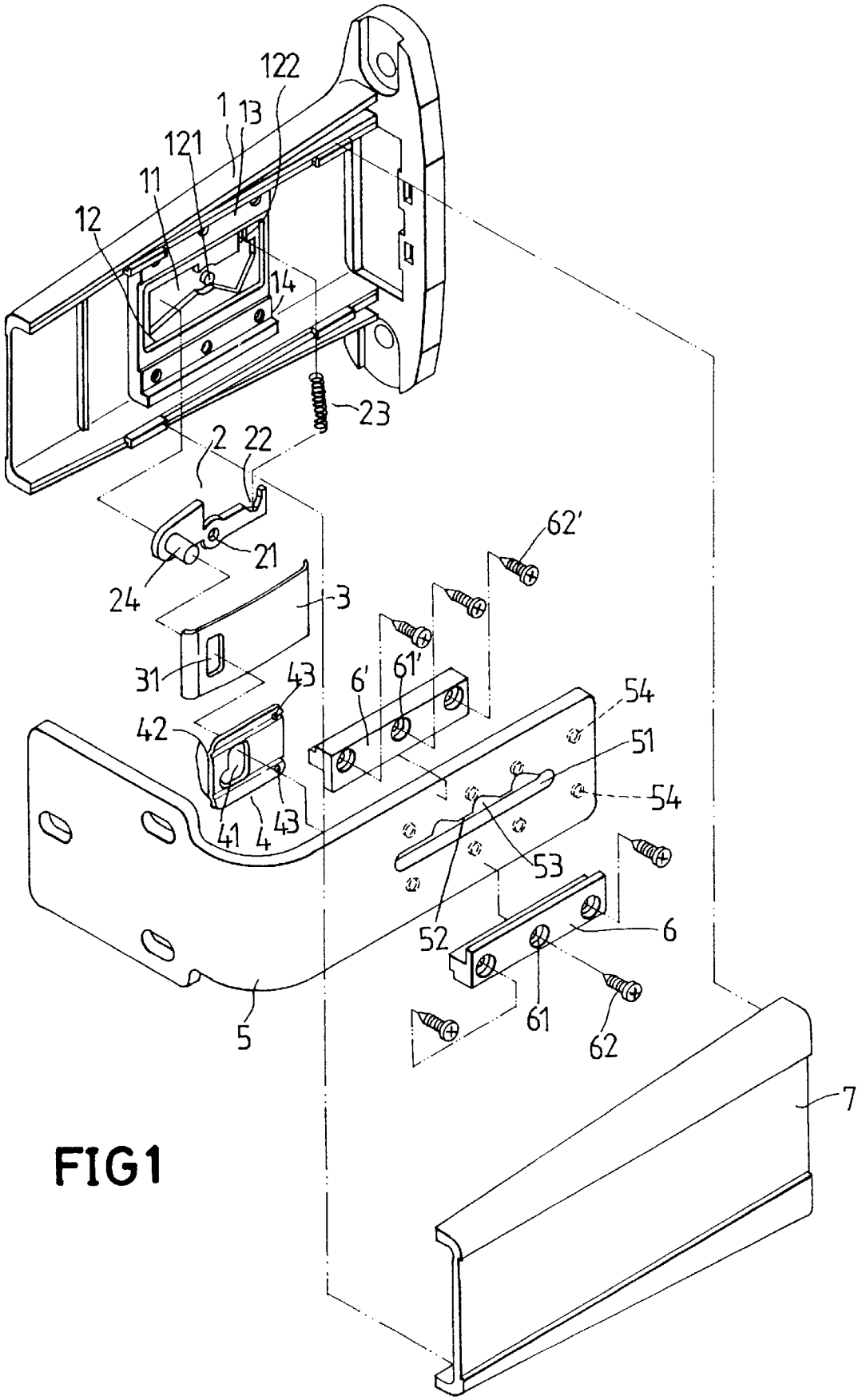
FIG. 1 is a perspective exploded view of an armrest device of a preferred embodiment in accordance with the present invention.
Figure 2:
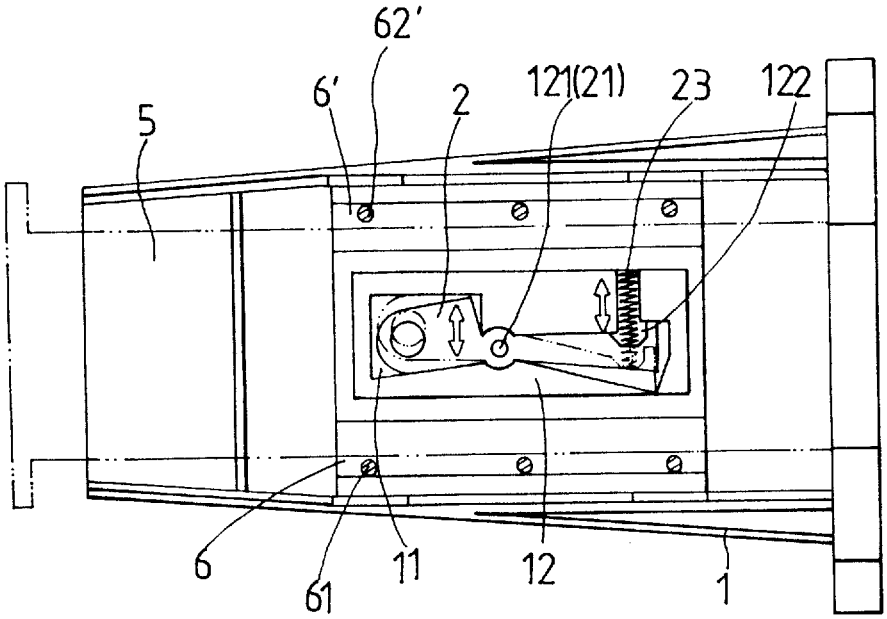
FIG. 2 is a front schematic view of an armrest device of a preferred embodiment in accordance with the present invention.
Figure 3:
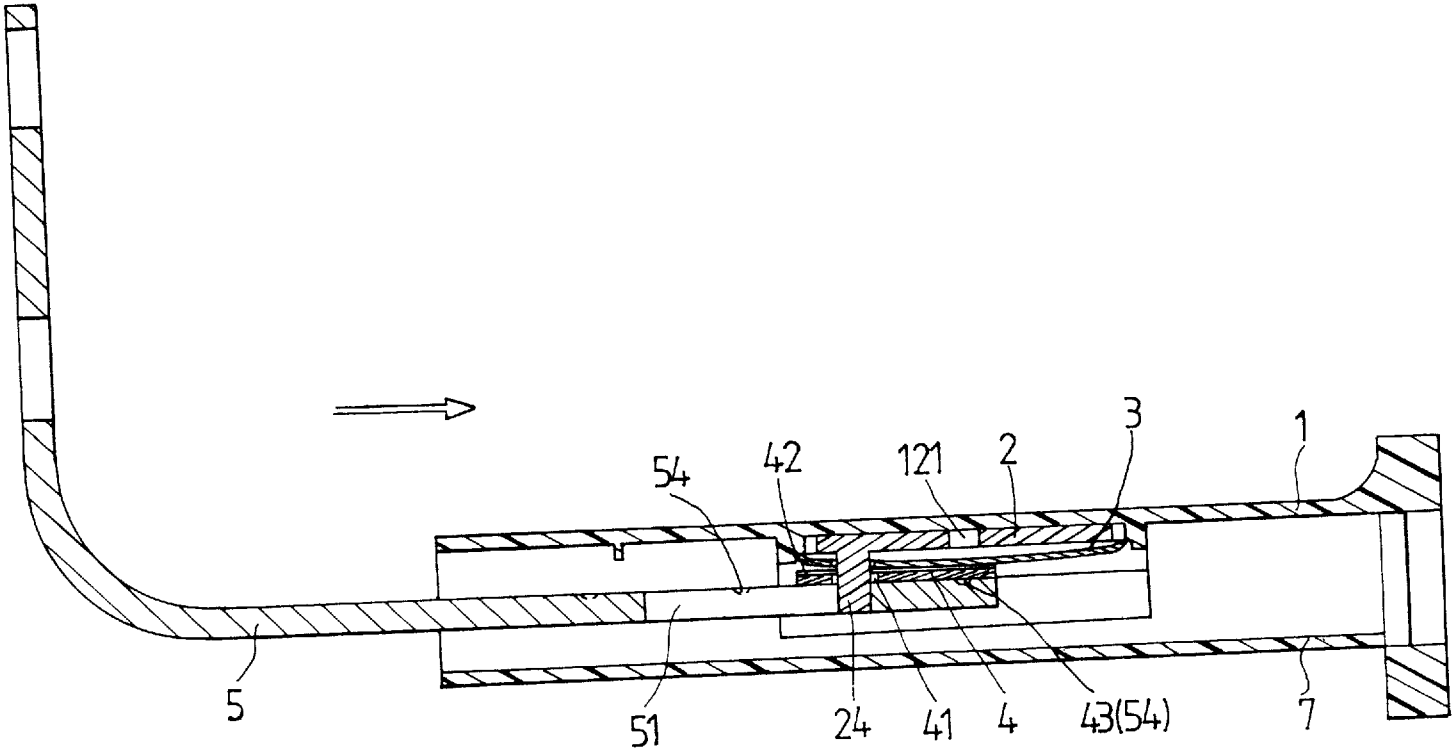
FIG. 3 is a sectional assembly view of an armrest device of a preferred embodiment in accordance with the present invention.

Referring to FIGS. 1 to 3 first, an armrest device comprises a main body 1, a cover plate 7 covering the main body 1, and an armrest support plate 5 inserted through a spacing defined between the main body 1 and the cover plate 7. The main body 1 has a first chamber 11, a second chamber 12, a middle post 121, a groove 122 communicating with the first chamber 11, a first seat 13, and a second seat 14. The armrest support plate 5 has a corrugated slot 51, and a plurality of recess apertures 54. The corrugated slot 51 has a linear portion 52 and a plurality of enlarged portions 53.

A hook device 2 has a shaft rod 24, a notch 22, and a through aperture 21 receiving the middle post 121. A coiled spring 23 has an upper end inserted in the groove 122 and a lower end inserted in the notch 22.

An elastic plate 3 covers the first chamber 11 and the second chamber 12. The elastic plate 3 has an oblong hole 31. A guide plate 4 is disposed on the elastic plate 3. The guide plate 4 has a through hole 41, two protruded edges 42, and two protrusions 43. The shaft rod 24 is inserted through the oblong hole 31, the through hole 41, and the corrugated slot 51. Each of the protrusions 43 is inserted in one of the recess apertures 54.

A press plate 6 is disposed on the second seat 14. The press plate 6 has a plurality of round holes 61. Each of the round holes 61 receives a bolt 62.

A press panel 6' is disposed on the first seat 13. The press panel 6' has a plurality of circular holes 61'. Each of the circular holes 61' receives a screw 62'.

The armrest support plate 5 is confined between the press plate 6 and the press panel 6'.

Figure 5:
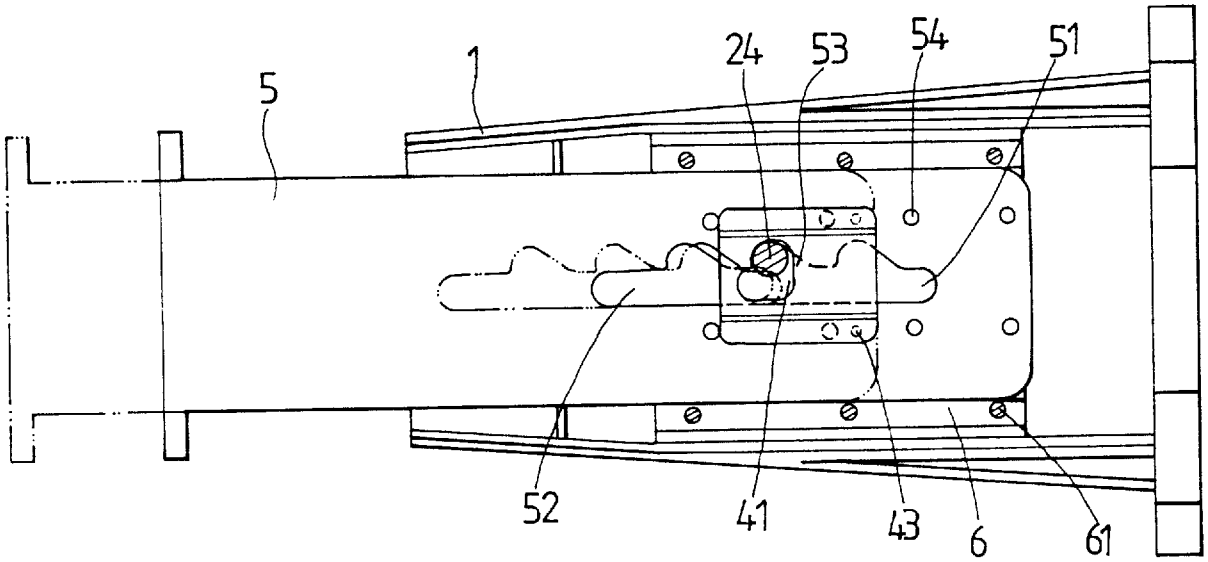
FIG. 5 is a schematic view illustrating another operation of an armrest device of a preferred embodiment in accordance with the present invention.

Referring to FIGS. 1 and 5, the main body 1 is moved toward the shoulder of the user. The shaft rod 24 moves along the corrugated slot 51.

Figure 4:
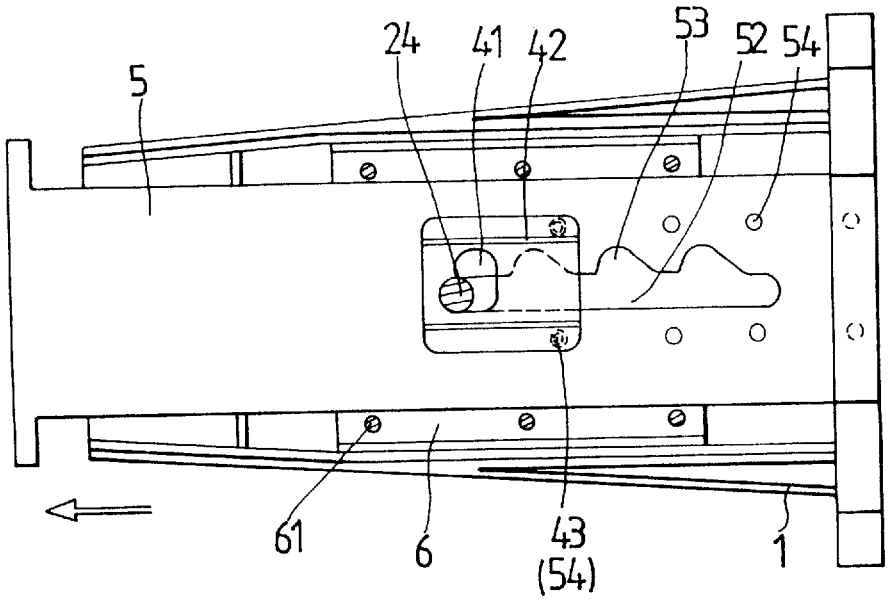
FIG. 4 is a schematic view illustrating an operation of an armrest device of a preferred embodiment in accordance with the present invention.

Referring to FIGS. 1 and 4, the main body 1 is moved toward the leg of the user. The main body 1 should be moved toward the opposite of the leg to the utmost first, then the main body 1 should be pulled out of the armrest support plate 5 so that the shaft rod 24 can be released from the corrugated slot 51. Then the main body 1 can be moved toward the leg of the user.

Thus the armrest device of the present invention can be adjusted easily.

The present invention is not limited to the above embodiment but various modification thereof may be made. Furthermore, various changes in form and detail may be made without departing from the scope of the present invention.

I claim:

1. An armrest device comprising:

a main body, a cover plate covering the main body, an armrest support plate inserted through a spacing defined between the main body and the cover plate, the main body having a first chamber, a second chamber, a middle post, a groove communicating with the first chamber, a first seat, and a second seat, the armrest support plate having a corrugated slot and a plurality of recess apertures, the corrugated slot having a linear portion and a plurality of enlarged portions, a hook device having a shaft rod, a notch, and a through aperture receiving the middle post, a coiled spring having an upper end inserted in the groove and a lower end inserted in the notch, an elastic plate covering the first chamber and the second chamber, the elastic plate having an oblong hole, a guide plate disposed on the elastic plate, the guide plate having a through hole, two protruded edges, and two protrusions, the shaft rod inserted through the oblong hole, the through hole, and the corrugated slot, each of the protrusions inserted in one of the recess apertures, a press plate disposed on the second seat, a press panel disposed on the first seat, and the armrest support plate confined between the press plate and the press panel.

2. An armrest device as claimed in claim 1, wherein the press plate has a plurality of round holes.

3. An armrest device as claimed in claim 1, wherein the press panel has a plurality of circular holes.

* * * * *